US005512816A

United States Patent [19]

Lambert

[11] Patent Number: 5,512,816

[45] Date of Patent: Apr. 30, 1996

[54] LOW-VOLTAGE CASCADED CURRENT MIRROR CIRCUIT WITH IMPROVED POWER SUPPLY REJECTION AND METHOD THEREFOR

[75] Inventor: Craig N. Lambert, San Jose, Calif.

[73] Assignee: Exar Corporation, San Jose, Calif.

[21] Appl. No.: 398,235

[22] Filed: Mar. 3, 1995

[51] Int. Cl.[6] ..... G05F 3/16

[52] U.S. Cl. ..... 323/315

[58] Field of Search ..... 323/312, 315, 323/316, 317; 330/257, 288; 327/538, 542, 543

[56] References Cited

U.S. PATENT DOCUMENTS

| | | | |
|---|---|---|---|
| 4,503,381 | 3/1985 | Bowers | 323/315 |
| 4,525,683 | 6/1985 | Jason | 330/288 |
| 4,647,841 | 3/1987 | Miller | 323/316 |
| 5,089,769 | 2/1992 | Petty et al. | 323/316 |
| 5,179,355 | 1/1993 | Harvey | 330/265 |
| 5,245,273 | 9/1993 | Greaves et al. | 323/313 |
| 5,420,542 | 5/1995 | Harvey | 330/292 |

*Primary Examiner*—Matthew V. Nguyen

*Attorney, Agent, or Firm*—Townsend and Townsend and Crew

[57] ABSTRACT

A circuit technique for improving power supply rejection of current mirror circuits. An input reference current is mirrored through a cascade of current mirror circuits whereby an error current is generated that represents the amount of current variation caused by power supply variations. The error current is then replicated into a current summing circuit which cancels out the effect of the error current. The output current is thus substantially independent of power supply variations.

10 Claims, 4 Drawing Sheets

LOW-VOLTAGE CASCADED CURRENT MIRROR CIRCUIT WITH IMPROVED POWER SUPPLY REJECTION AND METHOD THEREFOR

BACKGROUND OF THE INVENTION

The present invention relates in general to integrated circuits and in particular to current source circuits with improved power supply rejection.

Current sources are typically used in integrated circuits to set up the DC operating point (or biasing condition) of the circuit. The output of a current source is replicated (or multiplied by a factor) by current mirror circuits throughout a given circuit. As most of the operational parameters of a circuit depend on the DC operating point of that circuit, maintaining a constant bias condition is critical to the operation of the circuit. For example, it is often desirable to maintain a constant bias current even if the circuit power supply voltage varies. The ability of a circuit to resist changes in its operational parameters due to power supply voltage variations is commonly referred to as power supply rejection.

FIG. 1A shows an example of a mirroring current source circuit in bipolar technology. The current $I_1$ is set by current source 100 which is typically a resistive element that is connected between a power supply independent voltage and a diode-connected transistor Q1. This current is mirrored by transistors Q1 and Q2 to generate $I_2$, and mirrored again by transistors Q3 and Q4 to generate the output current $I_{out}$, variations in the power supply voltage of a conventional current mirror circuit such as the one depicted in FIG. 1A causes the output current Iout to change. This is due to the fact that the collector current of a bipolar transistor increases slowly with increasing collector-emitter voltage. The mirrored current can be mathematically approximated using the following equations:

$$I_2 = I_1\left(1+\frac{V_{CE_{Q2}}}{V_{A_N}}\right)$$

$$I_{out} = I_2\left(1+\frac{V_{CE_{Q4}}}{V_{AP}}\right) = I_1\left(1+\frac{V_{CE_{Q2}}}{V_{AN}}\right)\left(1+\frac{V_{CE_{Q4}}}{V_{AP}}\right)$$

where $V_{CE}$ is the collector-emitter voltage of the indicated transistor and VAN and $V_{AP}$ are the Early voltages of the NPN and PNP transistors, respectively. Given a typical $V_{CE}$ value of 3 volts and an Early voltage of +V, Iout would be more than 20% higher than 11.

The collector-emitter voltage $V_{CE}$ is the power supply dependent term in the above equation. The impact of the $V_{CE}$ term can be minimized by maximizing the output impedance $R_{out}$ of the transistors in the circuit. That is, the power supply rejection of a typical current mirror is proportional to the output impedance, $R_{out}$, of the transistors in the circuit. Higher output impedance results in higher power supply rejection. For the circuit shown in FIG. 1A, the output impedance of transistors Q2 and Q4 determine the level of power supply rejection. The output impedance of a transistor depends upon the fabrication process and the transistor geometry. With increasing emphasis on higher speed circuit fabrication processes, transistor sizes will continue to shrink. The smaller base widths of bipolar transistors and shorter gate lengths of field-effect transistors result in lower output impedances for these devices. Lower $R_{out}$ increases the circuit vulnerability to power supply variations.

Various techniques have been employed to increase the power supply rejection of a current mirror circuit. One approach is to increase device geometries (base widths or gate lengths). Increasing device geometries can be an option with MOSFETs or JFETs (longer channels) or with lateral bipolar transistors, because it can be readily implemented at the layout phase of the circuit (i.e., it does not require adjustments to the process). Longer base widths in vertical-bipolar transistors, however, requires a longer and probably richer base diffusion. This requires a process change and may not even be feasible due to speed requirements for other transistors in the circuit. Also, many circuits are developed on general-purpose arrays of transistors. In such cases, the circuit designer does not have the freedom to adjust device geometrics.

Another approach uses resistive degeneration to increase the effective output impedance. FIG. 1B shows the current mirror circuit of FIG. 1A with emitter degeneration resistors $R_e$. The value for the output impedance $R_{out}$ of the current source in FIG. 1B is given by:

$$R_{out} = \left(\beta\frac{R_e}{R_e + r_\pi + r_b + R_s} + 1\right)R_o$$

Where $\beta$= common-emitter current gain of the transistors $R_e$= emitter degeneration resistance $r_\pi=(\beta kT)/(qI_B)$ $r_b$= intrinsic base resistance $R_s$= source impedance $R_o$= output impedance of current source without degeneration resistors If $R_e$ can be made large enough to dominate the denominator of the above equation, the output impedance of the current source can be approximately equal to $\beta R_o$, almost always an acceptably large value. Thus, emitter degeneration works well if the emitter resistor $R_e$ can be made large enough. With any significant output current from the current source, however, the voltage dropped across the emitter resistor can become too large to permit the use of this technique in a low voltage circuit. Thus, resistive degeneration is not a satisfactory solution for low voltage (e.g., around 3 volts) applications.

Another circuit technique to increase output impedance employs cascode devices. A well-known example of this circuit is the Wilson mirror circuit shown in FIG. 1C. A cascode device can provide very high output impedance, but it has the same limitation as the emitter degeneration resistor. That is, the voltage required for the operation of this circuit is increased by one VBE (base-emitter turn-on voltage of the cascode transistors) for each mirror. In the example of FIG. 1C, the voltage requirement of the circuit increases by 2 $V_{BE}$. This is often more than the voltage that is available in the circuit.

It is therefore desirable to increase the power supply rejection of current source circuits without an increase in the minimum operating voltage.

SUMMARY OF THE INVENTION

The present invention provides a method and a circuit for increasing power supply rejection in current source circuits without having the voltage limitations of the aforementioned circuits or requiring the process changes to vertical bipolar devices.

According to one embodiment, the present invention provides a method for increasing power supply rejection in a current mirror circuit including the steps of (a) generating a replica of an uncorrected output current, (b) removing an amount of current equal to an input current to obtain an error current, and (c) removing an amount of current equal to the error current from the uncorrected output current to generate a corrected output current.

In another embodiment, the present invention provides a circuit including a current source having an output current I1 and a first current mirror circuit connected to the current source with an output current I2. The circuit further includes an error current generator connected to the first current mirror circuit for generating an error current $I_{eer}$ which is representative of the difference between an expected value of I2 and an actual value of I2. A second current mirror circuit connects to the output of the error current generator, and an output mirror transistor connects to both the first and the second current mirror circuits. The output mirror transistor generates at an output an error-free multiple of the current source output current I1.

A better understanding of the nature and advantages of the improved current mirror circuit of the present invention may be had by referring to the following drawings and the detailed description.

DESCRIPTION OF THE PREFERRED EMBODIMENT

Figure 2:
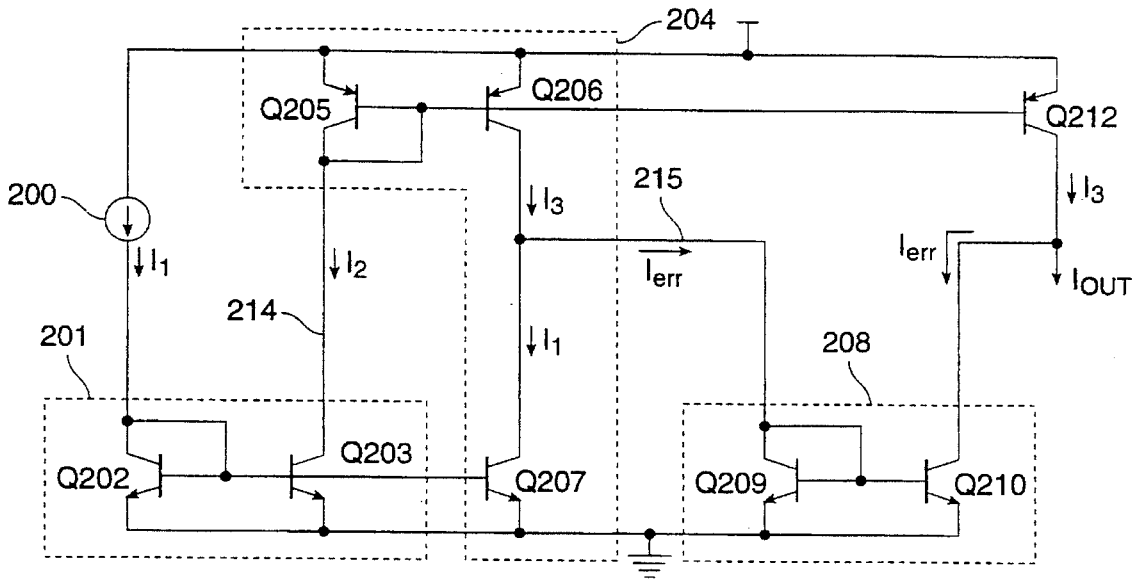
FIG. 2 is a simplified circuit diagram of a low voltage current mirror circuit according to one embodiment of the present invention.

Referring to FIG. 2, there is shown a simplified circuit diagram of the improved current mirror circuit according to one embodiment of the present invention. A current source 200 connects to a first current mirror circuit 201 made up of diode-connected transistor Q202 and transistor Q203. An error current generator 204, made up of transistors Q205, Q206 and Q207, connects to the output of current mirror circuit 201. A second current mirror circuit 208 made up of transistors Q209 and Q210 connects to the output of error current generator 204. An output current mirror transistor Q212 connects to the error current generator 204 and the output of current mirror circuit 208.

The operation of the circuit of FIG. 2 will be described hereinafter. With I1 as the output of current source 200, an approximate value of I2 at the output node 214 of current mirror circuit 201 is given by:

$$I_2 = I_1\left(1+\frac{V_{CE_{Q203}}}{V_{AN}}\right)$$

Transistors Q205 and Q206 of error current generator 204 perform another mirroring function such that the current I3 at the collector of transistor Q206 can be given by:

$$I_3 = I_1\left(1+\frac{V_{CE_{Q203}}}{V_{AN}}\right)\left(1+\frac{V_{CE_{Q206}}}{V_{AP}}\right)$$

The base terminal of transistor Q207, however, is connected to the base terminal of the diode-connected transistor Q202 of current mirror circuit 201. The collector of Q207 is clamped at one $V_{BE}$ up from ground, so that $V_{CE's}$ of Q202 and Q207 are very nearly equal. Thus, the collector terminal of transistor Q207 draws a current equal to I1. Since the collector terminals of transistors Q206 and Q207 connect to the same node 215, the difference in the collector currents I3 and I1 flows out of node 215 and into current mirror circuit 208. This is the error current $I_{eer}$ the value of which is given by:

$$I_{err} = I_3 - I_1 = I_1\left(1+\frac{V_{CE_{Q203}}}{V_{AN}}\right)\left(1+\frac{V_{CE_{Q206}}}{V_{AP}}\right) - I_1$$

Transistors Q209 and Q210 of current mirror circuit 208 replicate the error current $I_{eer}$ at the collector terminal of transistor Q210 which also connects to the output node. The base terminal of output mirror transistor Q212 connects to the base terminals of mirroring transistors Q205 and Q206. If the collectors of Q206 and Q212 are at about the same voltage, the collector current of transistor Q212 equals that of transistor Q206, namely I3. The output current Iout is therefore equal to the collector current of Q212 (I3) minus the current drawn by the collector current of Q210 ($I_{err}$). If the collector of Q210 is at about the same voltage as the collector of Q209, $I_{out}$ would be given by:

$$I_{out} = I_3 - I_{err} = I_1\left(1+\frac{V_{CE_{Q203}}}{V_{AN}}\right)\left(1+\frac{V_{CE_{Q206}}}{V_{AP}}\right) - I_1\left(1+\frac{V_{CE_{Q203}}}{V_{AN}}\right)\left(1+\frac{V_{CE_{Q206}}}{V_{AP}}\right) + I_1 = I_1$$

Accordingly, the impact of the supply voltage variations represented by the $V_{CE}$ terms in the above equation is cancelled by the error subtraction.

Figure 1A:
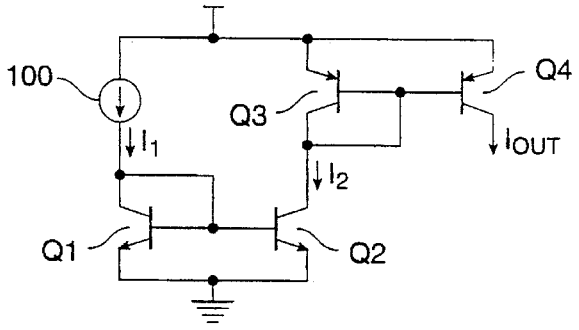
FIG. 1A PRIOR ART
FIGS. 1A, 1B, and 1C show prior art embodiments of current mirror circuits.
Figure 1B:
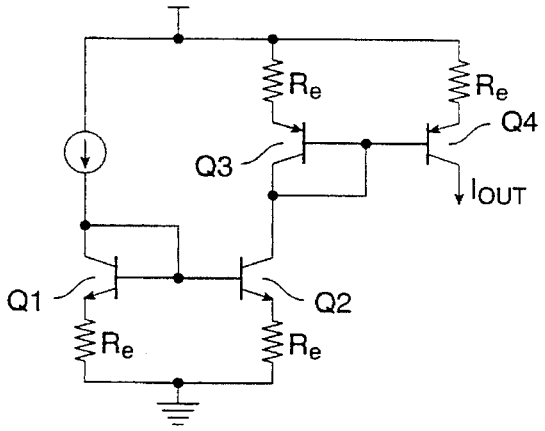
FIG. 1B PRIOR ART
Figure 1C:
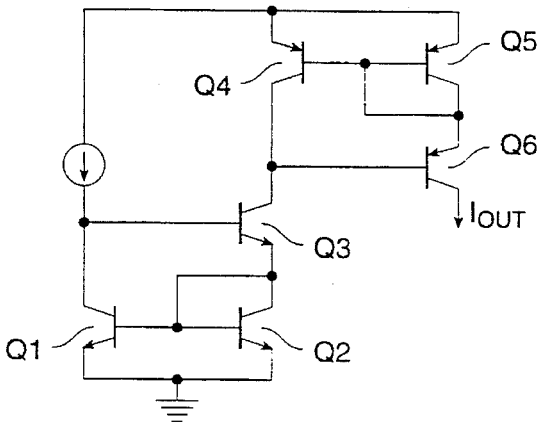
FIG. 1C PRIOR ART
Figure 3:
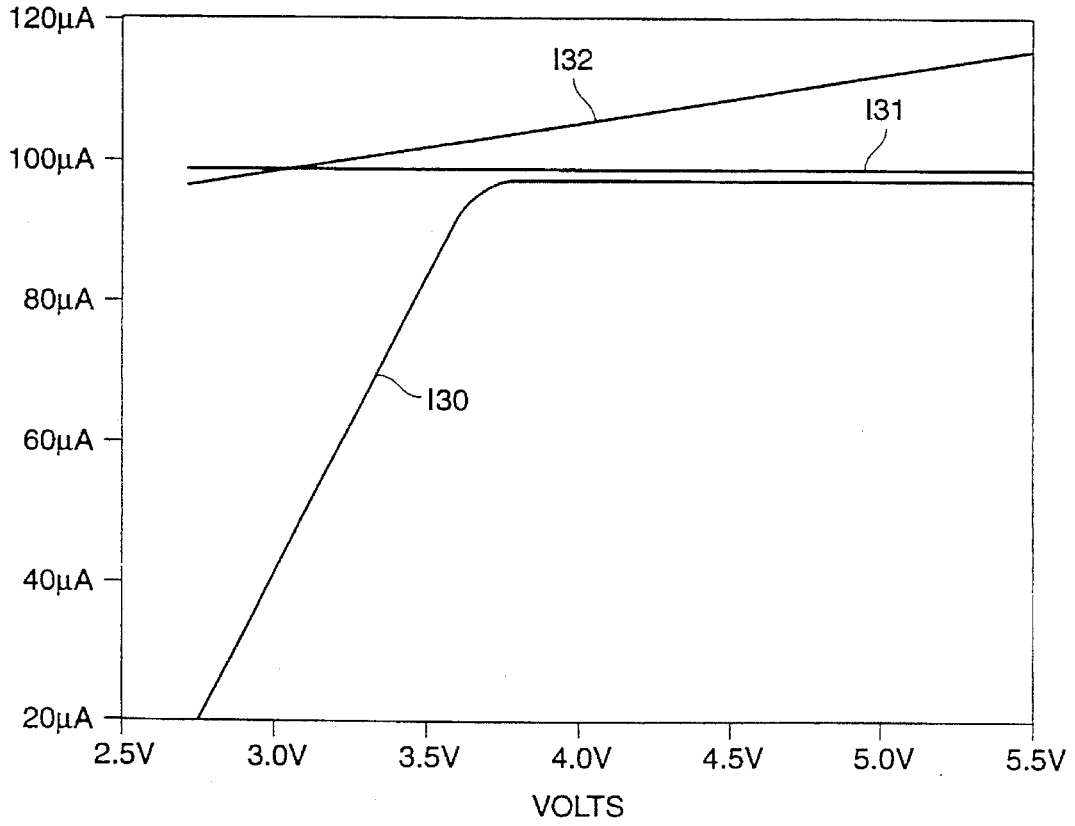
FIG. 3 illustrates measured improvements in the power supply rejection of the current mirror circuit of the present invention over the prior art.

The improvement in power supply rejection achieved by the circuit of FIG. 2 is diagrammatically illustrated in FIG. 3. The circuit power supply voltage is shown on the horizontal scale ranging from 2.5 volts to 5.5 volts, and the value of the circuit output current on the vertical scale of FIG. 3. The lines I30, I31, and I32 represent the value of the output current for circuits based on the prior art circuit of FIG. 1B, the circuit of the present invention as depicted in FIG. 2, and the prior art circuit of FIG. 1A, respectively. FIG. 3 provides a comparison of the output currents of the circuits designed for a target current of approximately 100 μA (input current). With the power supply voltage ranging from 3 V to 5.5 V, the error in the output current I32 of circuit of FIG. 1A is measured at about 16%. The value of the current at the output of the circuit of the present invention is shown by line I31 which measures virtually equal to the target value of 100 μA, irrespective of the supply voltage. The output current for the prior art circuit of FIG. 1B with emitter degeneration resistors is shown by line I30. The penalty paid by the use of this technique is illustrated by the severe degradation of the circuit performance for power supply voltages below about 3.8 V. While the variation in the amount of output current is minimal with the prior art circuit of FIG. 1B, the minimum operating voltage is raised by about 1 volt. Moreover, the error worsens considerably more rapidly with decreasing supply voltage in the circuit of FIG. 1B compared to the circuit of the present invention.

The exemplary embodiment of the present invention shown in FIG. 2 improves the power supply rejection of the type of current mirror circuit shown in FIG. 1A. It is to be understood that the same technique can be applied to current mirror circuits using PNP type devices as the primary mirroring circuit as well as MOSFET circuits, or any combination thereof.

Figure 4:
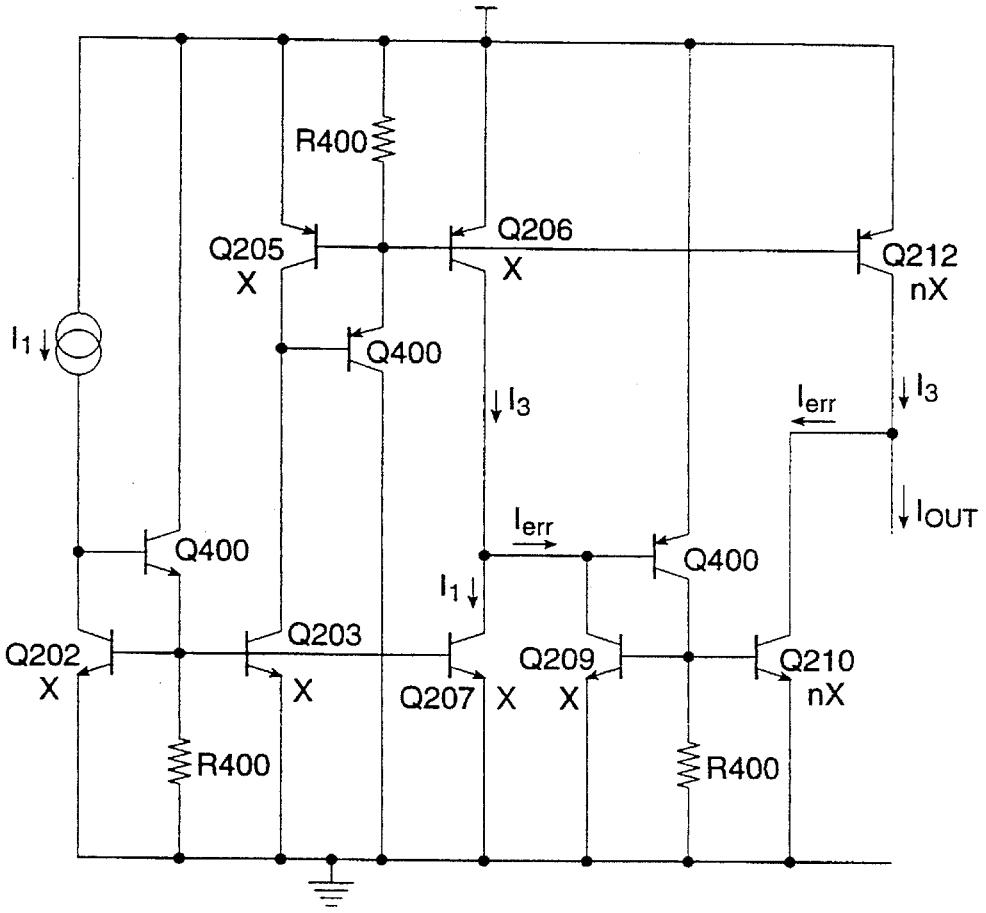
FIG. 4 is a more detailed circuit diagram of a low voltage current mirror circuit according to one embodiment of the present invention.

FIG. 4 shows the low voltage current mirror circuit of the present invention in greater detail. The circuit of FIG. 4 is basically the same as that of FIG. 2 except for the inclusion of resistors R400 at the common base terminals of each pair of mirroring transistors, and the use of emitter-follower transistors Q400 to connect the base and collector of previously diode-connected devices. Resistors R400 and transistors Q400 reduce error currents due to finite value of transistor gains β. At times, a current mirror circuit is required to have current gain, with the output current differing from the input current by a fixed ratio. FIG. 4 also demonstrates the use of the technique of the present invention in a mirror circuit whose output current is n times as large as the input current.

The error current in the circuit of FIG. 4 is generated in a similar fashion to that of circuit of FIG. 2. However, both the output current and the error current are multiplied through the use of larger transistors. The multiplication is accomplished by making transistors Q210 and Q212, n times as large as transistors Q209 and Q205, respectively. Replicating the input current by subtracting the error current from the output current is achieved in the same way as described in connection with FIG. 2.

Figure 5A:
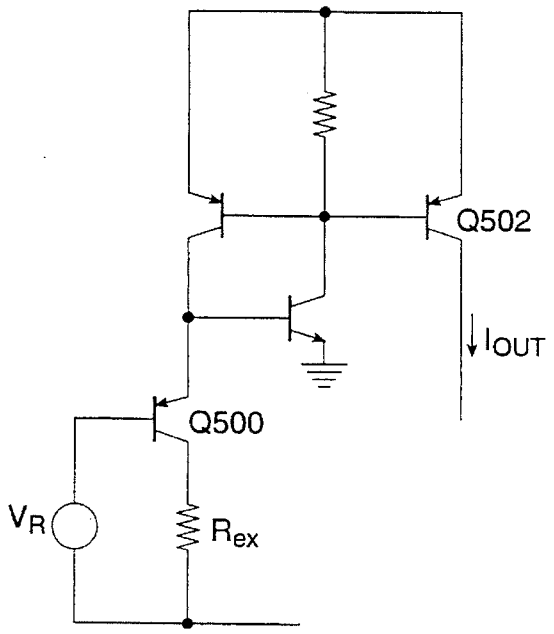
FIG. 5A and 5B show externally programmable current mirror circuits with "uncorrected" output current (prior art), and corrected output current according to the present invention, respectively.
Figure 5B:
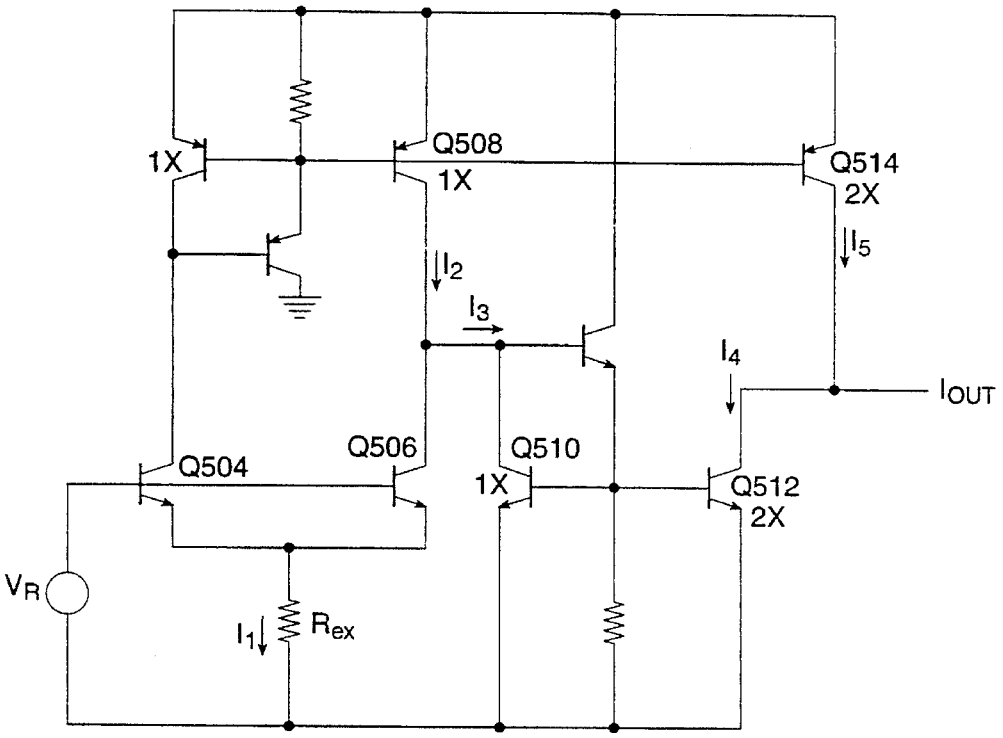

In some applications, current mirror circuits allow the user to set the reference current. Setting the center frequency of a programmable filter or the reference current for a digital to analog converter are two examples of such applications. FIGS. 5A and 5B show externally programmable current mirror circuits with "uncorrected" output current (prior art), and corrected output current according to the present invention, respectively. In the "uncorrected" case, shown in FIG. 5A, the current in Q500 is set by an internal reference voltage, $V_R$, and an external resistor, $R_{EX}$. In this case, the desired output current is $(V_R-V_{BEQ500})/R_{EX}$. The resulting output current, however, is larger than the target value by a factor of $(1+V_{CEQ502}/V_{AP})$.

The present invention corrects for the error current as shown in FIG. 5B. The reference current, I1, is split between identical transistors Q504 and Q506. The error current is generated in a similar fashion except the error current mirror transistors double the amount of current. This is accomplished by making the size of transistor Q512 twice that of transistor Q510. To simplify the math for the moment, assume that Q504's collector current varies negligibly with supply voltage. The currents in the circuit, then, are as follows:

$$I_2=\frac{I_1}{2}\left(1+\frac{V_{CE_{Q508}}}{V_{AP}}\right)$$

$$I_3=\frac{I_1}{2}\left(1+\frac{V_{CE_{Q508}}}{V_{AP}}\right)-\frac{I_1}{2}$$

-continued $$I_4=2I_3=I_1\left(1+\frac{V_{CE_{Q508}}}{V_{AP}}\right)-I_1$$

$$I_5=2I_2=I_1\left(1+\frac{V_{CE_{Q508}}}{V_{AP}}\right)$$

$$I_{out}=I_5-I_4=I_1$$

In actuality, however, the collector current of Q504 will increase with supply voltage if it is not absolutely constrained from doing so. In that case, since $I_1$ must remain constant, the collector current of Q506 must decrease accordingly, so $I_3$ and $I_4$ increase at a faster rate than $I_5$. This makes the output current, $I_{out}$, decrease slightly with increasing supply voltage. If the early voltage $V_A$ for the process in which the bipolar circuit is fabricated is sufficiently well known, resistors can be placed from the emitters of Q510 and Q512 to ground to set the ratio $I_4/I_3$ to slightly less than 2, to reduce or eliminate the overcorrection, at least to the first order.

Figure 6:
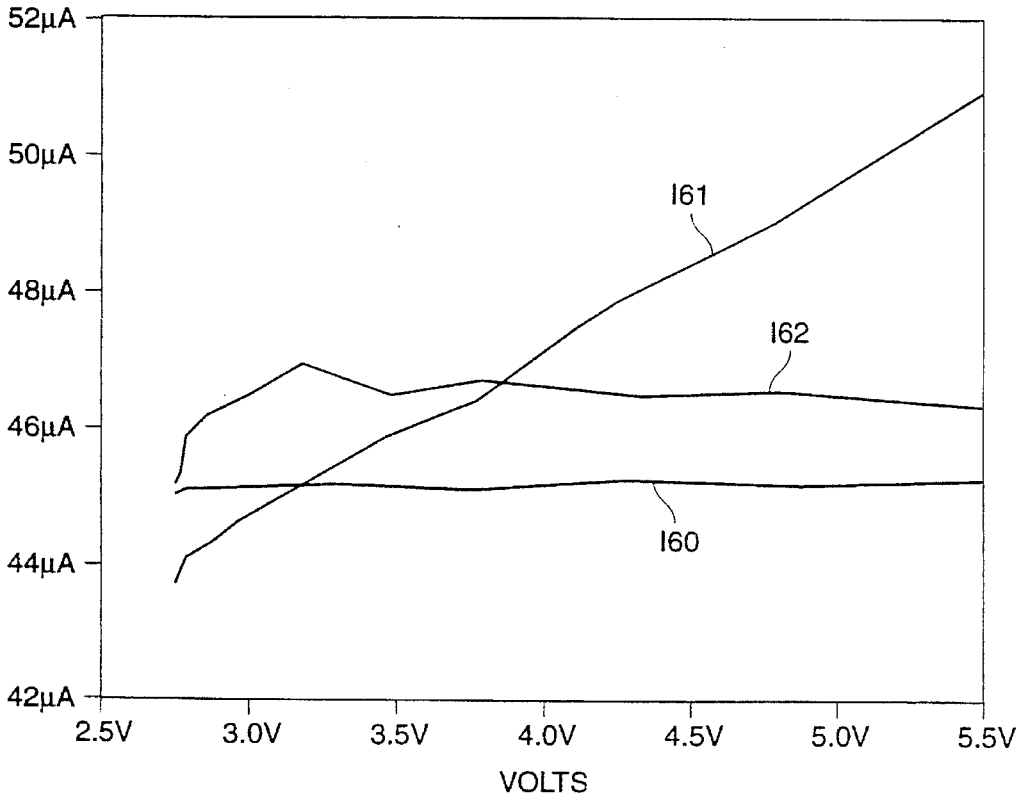
FIG. 6 illustrates measured improvements in the power supply rejection of the second embodiment of the current mirror circuit of the present invention.

The measurement results comparing the performance of the two circuits of FIGS. 5A and 5B are shown in FIG. 6. The line designated I60 is the target current for the circuit of both FIGS. 5A and 5B. The output currents of circuits of FIGS. 5A and 5B are designated in FIG. 6 as I61 and I62, respectively. In accordance with the derivation above, the uncorrected output current I61 increases linearly with increasing supply voltage, while the output current I62 of the corrected circuit according to the present invention decreases slightly with supply voltage. FIG. 6 shows that for voltages above about approximately 3.1 volts the circuit of the present invention as shown in FIG. 5B rejects power supply variations significantly better than the prior art circuit of FIG. 5A.

In conclusion, the present invention provides a method and a circuit technique for significantly reducing output current variations in current mirror circuits caused by power supply variations. The technique of the present invention allows current mirror circuits to operate at lower voltages with higher power supply rejection. While the above is a complete description of several embodiments of the present invention, it is possible to use various alternatives, modifications and equivalents. For example, the same techniques can be applied to current mirror and reference circuits using MOSFET technology or a combination of bipolar and MOSFET technologies. Therefore, the scope of the present invention should be determined not with reference to the above description but should, instead, be determined with reference to the appended claims, along with their full scope of equivalents.

What is claimed is:

1. A circuit comprising:

a current source providing an input current (I1);

a first current mirror circuit coupled to said current source, said first current mirror circuit having an output current (I2);

an error current generator coupled to said first current mirror circuit, said error current generator generating at an output an error current ($I_{eer}$) representative of the difference between an expected value of said input current (I1) and an actual value thereof;

a second current mirror circuit coupled to said output of said error current generator for replicating said error current ($I_{err}$); and a summing circuit coupled to said error current generator and said second current mirror circuit, said summing circuit generating at an output a current substantially equal to said input current (I1), or a designed multiple thereof.

2. The circuit of claim 1 wherein said error current generator comprises:

a third current mirror circuit coupled to said first current mirror circuit, said third current mirror circuit having an output current (I3) at an output; and an input current replicator coupled to said output of said third current mirror circuit, wherein, said input current replicator subtracts an amount of current substantially equal to said input current (I1) from said output current of said third Current mirror circuit (I3) to generate said error current ($I_{eer}$).

3. A circuit comprising:

a current source for providing an input current (I1);

a first pair of transistors having common control terminals and forming a first current mirror circuit with an input coupled to said current source, said first current mirror circuit generating a first mirror current (I2) at an output;

a second pair of transistors having common control terminals and forming a second current mirror circuit with an input coupled to said first current mirror circuit output, said second current mirror circuit generating a second mirror current (I3) at an output;

a first mirror transistor having a control terminal coupled to said control terminals of said first pair of transistors, and an output coupled to said output of said second pair of transistors;

a third pair of transistors having common control terminals and forming a third current mirror circuit with an input coupled to said second current mirror circuit output, said third current mirror circuit generating an error current $I_{err}$ at an output; and a second mirror transistor having a control terminal coupled to said control terminals of said second pair of transistors, and an output coupled to said output of said third pair of transistors.

4. The circuit of claim 3 wherein said first, second and third pairs of transistors in said first, second and third current mirror circuits have a first input diode-coupled transistor and a second output transistor.

5. The circuit of claim 4 wherein all transistors are bipolar transistors.

6. The circuit of claim 4 wherein all transistors are field effect transistors.

7. The circuit of claim 4 wherein said pairs of transistors and mirror transistors are selectively implemented in field effect transistor technology and bipolar transistor technology.

8. The circuit of claim 4 wherein some current mirrors comprise bipolar transistors and others comprise field-effect transistors.

9. The circuit of claim 4 wherein each of said current mirror circuits further comprises:

an emitter-follower transistor to connect a base and a collector of said diode-coupled transistor; and a resistor coupled between said common base terminals and a power supply terminal or ground.

10. A method for increasing the power supply rejection of current mirror circuits comprising the steps of:

(a) mirroring an input current (I1) with a first current mirror circuit to generate a first current (I2);

(b) mirroring said first current (I2) with a second current mirror circuit to generaate a second current (I3);

(c) subtracting a replica of said input current (I1) from said second current (I3) to generate an error current;

(d) mirroring said first current (I2) to generate a third current (I4); and (e) subtracting a replica of said error current from said third current (I4) to generate an output Iout substantially equal to said input current (I1), or a designed multiple thereof.

* * * * *

UNITED STATES PATENT AND TRADEMARK OFFICE

CERTIFICATE OF CORRECTION

PATENT NO. : 5,512,816

DATED : April 30, 1996

INVENTOR(S) : Craig N. Lambert

It is certified that error appears in the above-indentified patent and that said Letters Patent is hereby corrected as shown below:

Column, 1, line 30, change "$I_{out}$'" to --$I_{out}$.--.

line 31, change "variations" to --Variations--.

line 33, change "causes" to --cause--, and change "Iout" to --$I_{out}$--.

line 46, change "VAN" to --$V_{AN}$--.

line 48, change "+V" to --30V--, and change "Iout" to --$I_{out}$--.

Column 2, line 15, change "geometrics" to --geometries--.

Column 3, line 14, change "$I_{eer}$" to --$I_{err}$--.

Column 4, line 14, change "$V_{CE's}$" to --$V_{CE}$'s--.

line 21, change "$I_{eer}$" to --$I_{err}$, --.

line 27, change "$I_{eer}$" to --$I_{err}$--.

line 33, change "Iout" to --$I_{out}$--.

UNITED STATES PATENT AND TRADEMARK OFFICE

CERTIFICATE OF CORRECTION

PATENT NO. : 5,512,816

DATED : April 30, 1996

INVENTOR(S) : Craig N. Lambert

It is certified that error appears in the above-indentified patent and that said Letters Patent is hereby corrected as shown below:

Column 6, line 58, change "$I_{eer}$" to --$I_{err}$--.

Column 7, line 13, change "Current" to --current--.

line 14, change "$I_{eer}$" to --$I_{err}$--.

Signed and Sealed this

Eighteenth Day of February, 1997

*Attest:*

BRUCE LEHMAN

*Attesting Officer*

*Commissioner of Patents and Trademarks*